US007822352B2

(12) United States Patent
Coleman et al.

(10) Patent No.: US 7,822,352 B2
(45) Date of Patent: Oct. 26, 2010

(54) THERMALLY CONDITIONED IMAGE FORMING APPARATUS

(75) Inventors: Larry Christopher Coleman, Knoxville, TN (US); Douglas Campbell Hamilton, Lexington, KY (US); Johnny Ray Sears, Versailles, KY (US); Larry Earl Stahlman, Versailles, KY (US); Casey Thomas Wilson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 186 days.

(21) Appl. No.: 11/231,010

(22) Filed: Sep. 20, 2005

(65) Prior Publication Data

US 2007/0065168 A1 Mar. 22, 2007

(51) Int. Cl.
*G03G 15/20* (2006.01)

(52) U.S. Cl. ..... 399/70; 399/328; 399/330

(58) Field of Classification Search ..... 399/67–68, 399/70, 328, 330
See application file for complete search history.

(56) References Cited

U.S. PATENT DOCUMENTS 4,996,567 A 2/1991 Watarai et al.
5,300,999 A 4/1994 Koh et al.
5,489,761 A 2/1996 Aslam et al.
5,852,763 A * 12/1998 Okuda et al. ..... 399/329
5,983,048 A 11/1999 Moser
5,999,764 A * 12/1999 Okabayashi et al. ..... 399/67
6,078,781 A * 6/2000 Takagi et al. ..... 399/330
6,157,806 A 12/2000 Elbert et al.
6,175,699 B1 * 1/2001 Kato et al. ..... 399/69
6,263,172 B1 * 7/2001 Suzuki et al. ..... 399/67
6,266,510 B1 7/2001 Curry et al.
6,272,310 B1 8/2001 Blair et al.
6,795,677 B2 9/2004 Berkes et al.
7,054,573 B2 * 5/2006 Hirai et al. ..... 399/70
2009/0238597 A1 * 9/2009 Cao et al. ..... 399/70

* cited by examiner

*Primary Examiner*—David M Gray
*Assistant Examiner*—Geoffrey T Evans

(57) ABSTRACT

The present invention relates to an article, system and method for thermally conditioning an image forming apparatus. The image forming apparatus may incorporate a heating device and a component that includes a lubricant. The component including the lubricant may be preheated before movement and then rotated at reduced speeds prior to a printing operation. This may occur during an image forming apparatus cold start or power saver mode.

18 Claims, 4 Drawing Sheets

THERMALLY CONDITIONED IMAGE FORMING APPARATUS

FIELD OF INVENTION

The present invention relates to an article, system and method for thermally conditioning an image forming apparatus. The image forming apparatus may be an electrophotographic or ink printer, copier, fax, all-in-one device, or multipurpose device.

BACKGROUND

An image forming apparatus, such as a printer, copier, fax, all-in-one device, or multipurpose device may use developing agent such as toner, ink or other image forming substance, which may be disposed on media to form an image. The developing agent may be fixed to the media using an image forming apparatus, which may apply heat and/or pressure to the toner. The image forming apparatus may include a nip through which the media may be passed. The nip may be formed by a heating device opposing a roller, such as a pressure roller or a back-up roller. A component, such as a belt or film, may be included in the forming device, in proximity to the heating device to aid the transport of media through the fixing device nip.

SUMMARY

In an exemplary form, the present invention relates to an apparatus, article and method for conditioning a component in an image forming apparatus that includes a lubricant. A heating device may be heated to a first selected temperature wherein the lubricant may exhibit a targeted viscosity and the heating device may be maintained at the first selected temperature for a selected period of time prior to moving the component.

DETAILED DESCRIPTION

The present invention relates to an article, apparatus and method for thermally conditioning an image forming apparatus. The thermal conditioning may, e.g., reduce stress in a component of the image forming apparatus. An image forming apparatus may include a printer, copier, fax, all-in-one device or a multifunctional device.

Figure 1:
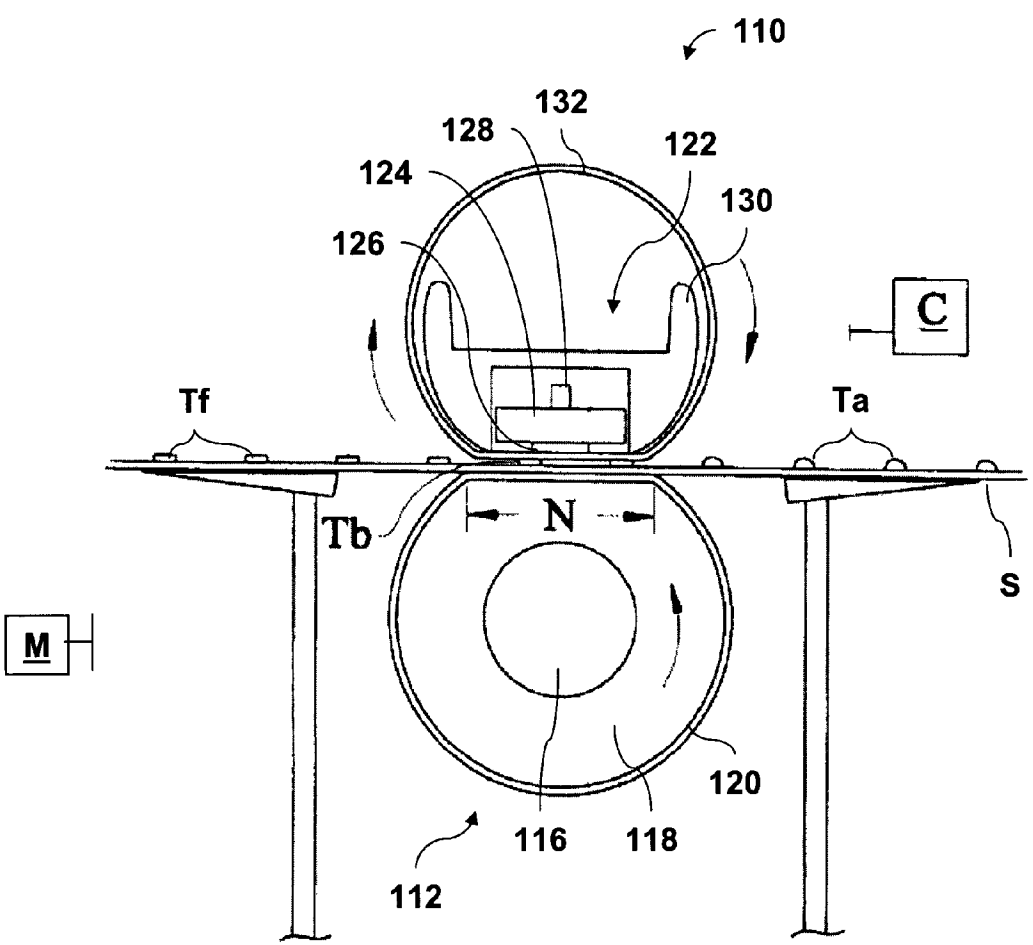
FIG. 1 is a side view of an exemplary embodiment of an image forming apparatus.

Referring now to FIG. 1, an exemplary image forming apparatus 110 is depicted. The image forming apparatus may include a roller 112, a heating device 122 and component such as a belt or film 132. The roller 112 may include a number of configurations. For example, the roller 112 may include a shaft portion 116. The shaft portion 116 may be formed from steel, aluminum, or other metallic or plastic materials. Covering the shaft portion may be a polymeric layer 118, such as a rubber or elastic layer. The polymeric layer 118 may be formed from silicon rubber or other thermoplastic or thermoset materials.

Covering the polymeric layer 118 may be an additional layer or sleeve 120. The additional layer 120 may incorporate low energy material such as polytetrafluoroethylene, perfluoroalkoxy, fluorinated ethylene propylene, fluoroelastomers and other fluoropolymers and combinations of fluoropolymers. The roller 112 may be driven by a motor M in communication with the roller 112.

The heating device 122 may include a number of elements. For example, the heating device may include a heater substrate 124, which may include one or more segments. The substrate may be composed of ceramic material. Furthermore the substrate may be electrically insulative, have a high thermal conductivity, a high heat resistance and/or a low thermal capacity. The heating device may also include one or more heat-generating electrical resistors 126. The resistors may extend along the length of the substrate 124. A temperature detecting element 128 may be included in the heating device 122. The temperature detecting element 128 may include a thermistor or a thermostat. The temperature detecting element 128 may be mounted in contact with the substrate member 124 and in one embodiment may be mounted on a surface of the substrate member 124 opposite an electrical resistor 126.

The heating device may communicate with a processor "C." The processor may be a microprocessor 16 or other processor located within the printing or the fixing device 122. The heating device may be fixed to a holder 130. A thin layer of electrical insulation such as glass (not shown) may cover the electrical resistors 126. An additional component 132, such as a belt or film, may also be included that may surround the heating device 122.

The component 132 may be composed of a relatively high heat resistant and/or durable material such as a polymeric material. The polymeric material may include by way of example, but is not limited to, a polyimide, polyetherimide, polyetherketone, polyamide-imide, polyphenylene-sulfide, etc. The component 132 may also be an endless tube and may be between 40-100 microns in thickness. The component 132 may also include an outer layer (not illustrated) incorporating a relatively low surface energy material such as polytetrafluoroethylene, perfluoroalkoxy, fluorinated ethylene propylene, fluoroelastomers and other fluoropolymers and combinations of fluoropolymers and other materials.

A layer of relatively viscous lubricant or grease may also be applied to the inner surface of the component 132 that contacts the heating device 122. In that sense the lubricant or grease may be understood to be any material which engages the component and which may lubricate the component during a printing operation. The lubricant may be relatively viscous perfluoropolytrimethylene oxide (a repeating polymer of three fully fluorinated methylene moieties in a straight chain terminated by an oxygen.) The lubricant may be thickened or made more viscous by the addition of polytetrafluoroethylene spherical particles that may be between 0.1-1.0 microns in diameter. The grease may have an apparent viscosity, for example, of about 5300 milliPascal-seconds at 250 degrees C at shear rates of 300 per second. Furthermore, as the temperature of the grease increases, the viscosity of the grease may decrease.

As alluded to above, the media S may pass from a developer, where a developing agent or image forming substance may be deposited, to the heating device and roller. Prior to fixing, the toner (designated as "Ta" in FIG. 1) may be loose on the sheet of media S. The toner and media may enter the nip (N) between the heating device 122 and the roller 112. The component 132 may be driven by contact with the roller 112 or by driving members (not illustrated). For example, the roller 112 may contact the component 132 with about 5-20 kilograms of force. Once the media enters the nip N, the toner may be heated and may fuse to the media S, exiting the nip N in a fused state which is designated as Tf in FIG. 1.

The component 132 may be subjected to a number of stresses. For example, a print job may be sent to an image forming apparatus when the image forming apparatus may be in a cold or unheated state. Abrupt acceleration of the component and/or abrupt increase in temperature of the heating device from the cold state may cause thermal and/or mechanical shock to the component. In some instances the shock may cause deformation of the component and may even render the component unusable if the shock is severe enough or reoccurring. Accordingly, the present invention in an exemplary embodiment may reduce or manage shock in the component 132.

In one embodiment, the heating device may be heated to provide a conditioning temperature Tc. The conditioning temperature Tc may be greater than ambient or room temperature. The conditioning temperature Tc may also allow for the viscosity of the lubricating grease to attain a desired flow condition which may then provide desired component lubrication. Accordingly, a conditioning temperature Tc may be identified for preheating in which the viscosity of the lubricant may reach a desired viscosity or flow value (μ) expressed in mPa-seconds. The flow value μ may be a particular flow value or a range of flow values.

It can be appreciated that the conditioning temperature Tc may vary for different types of lubricants or grease materials. It should also be appreciated that the conditioning temperature Tc may be a particular temperature range. In addition, the conditioning temperature Tc herein may be provided prior to printing (e.g. cold start mode) or whenever the image forming apparatus is in a mode of operation wherein it may be desirable to maintain the lubricant or grease at the targeted flow value μ, such as in a power saver mode.

Once it has been determined that the component 132 has been sufficiently heated at a desired temperature to where a desired viscosity may be established for the lubricant (e.g., grease), such as after a given time period, the component may then be rotated at a first speed, e.g. a warm-up speed or "$SP_w$." The warm-up speed may be less than the printing speed. The warm-up speed may therefore be, e.g., 1-99% of the printing speed, including all values and increments therebetween.

Additionally, another temperature adjustment or series of temperature adjustments may then occur in order to raise the temperature of the heating device up to a desired printing temperature. This may include sequencing the heating device to other higher temperatures or adjusting the heating device to a final desired printing temperature. The motor speed may also be increased to a desired printing speed "PS" prior to the start of printing.

Once a print job has been completed, one may keep the image forming apparatus in a condition wherein the heating device temperature may be set (e.g. cooled) to a desired conditioning temperature to maintain a desired flow value (μ) for the accompanying lubricant or grease, again expressed in mPa-seconds. For example, the image forming apparatus may enter into a standby mode (in which the heating device may typically be heated) and/or a power saver mode (in which the heating device typically does not have power consumption and is not heated). In either case, the heating device may be maintained at a conditioning temperature Tc wherein the lubricant viscosity μ may be controlled to a target flow value.

In connection with the control of lubricant viscosity μ as noted above, the temperature to maintain a desired lubricant viscosity μ may be a function of the grease chosen. This may also assure that desired lubrication may be present prior to the rotation of the component. One may therefore avoid the presence of a component that may be otherwise relatively weak or brittle. One may also now reduce or minimize the stress and/or wear that may develop on the component induced by motion in the absence of the thermally conditioned lubricant or grease. Thermal conditioning of the lubricant or grease may also reduce what may sometimes be referred to as component deformation and/or "component crinkling." Furthermore, by providing a preheat time prior to rotation of the component, the component or at least the portion of the component present at, e.g. a nip, may reach a given desired temperature before motion may be induced. This may place the component in a more optimal state to allow for stress relief from the forces induced by component motion.

It may also be appreciated that by providing a first rotation speed for the component, wherein the component is rotated at, for example, a warm-up speed, a degree of acceleration shock may be avoided. A higher degree of acceleration shock may otherwise occur when the component is rotated almost instantaneously from a static state to the rotational velocities experienced in printing. This shock may also cause component deformation and/or "component crinkling."

By switching into power saver mode it may be possible to comply with Energy Star® or Blue Angel™ requirements even though the temperature of the heating device may be maintained at all times to sustain the desired lubricant or grease viscosity μ. Energy Star® requirements are compiled by and may be available from the United States Environmental Protection Agency and the Department of Energy, Washington, D.C. Blue Angel™ requirements for printers, for example, are included in RAL-UZ 85 complied by and may be available from the Ral German Institute for Quality Assurance and Certification, Sankt Augustin Germany.

Figure 2:
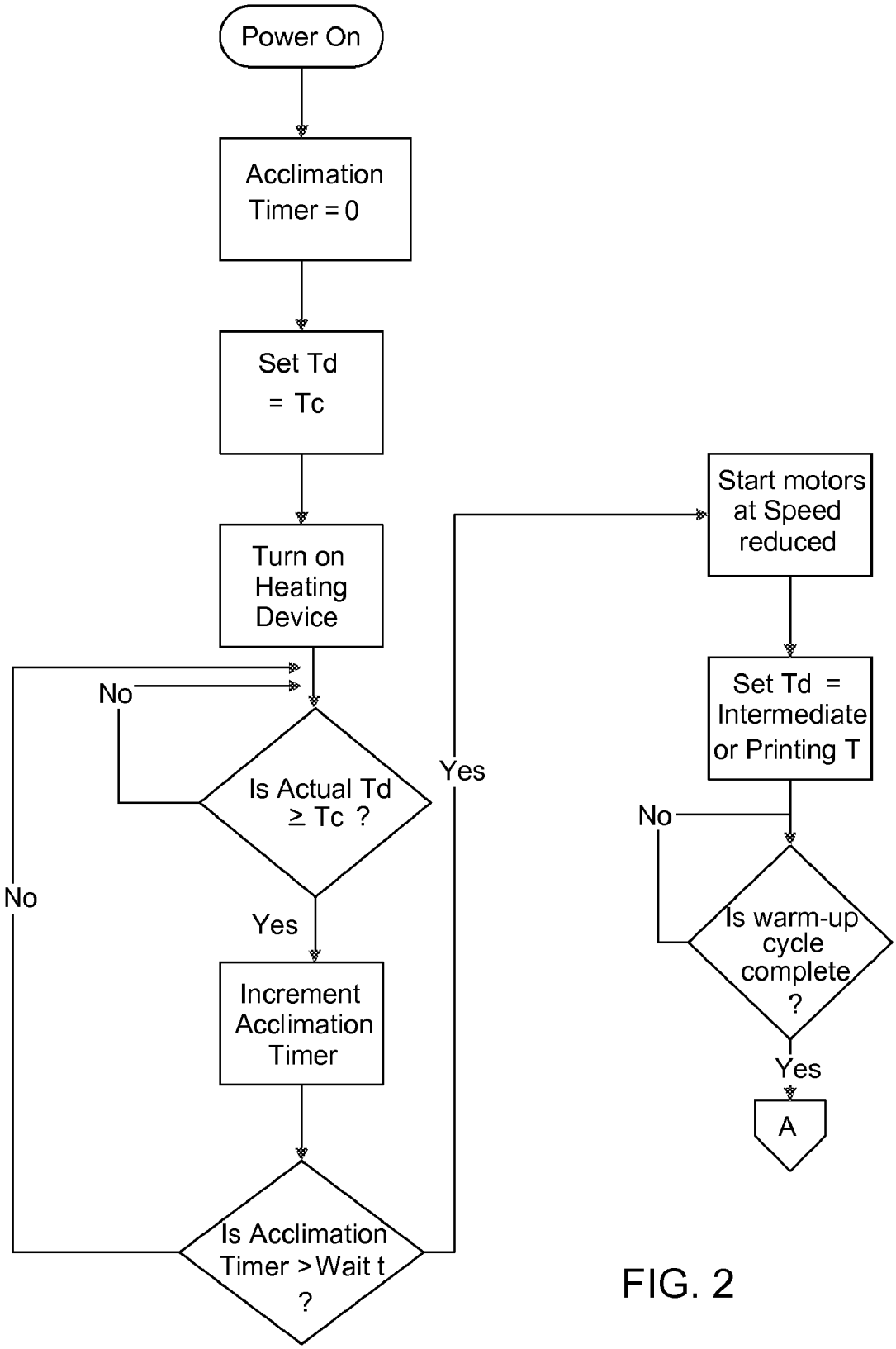
FIGS. 2 and 3 are a flow diagram illustrating an exemplary embodiment of the present invention.

An exemplary embodiment of the present invention is illustrated in FIG. 2. A method and or system may be provided which may begin by turning the image forming apparatus on at 210. An acclimation timer, which may be used to measure a preheat period may be turned on or set at zero at 212. The heating device temperature Td may also be set to provide a conditioning temperature Tc at 214. As alluded to above, this temperature may be targeted to provide a desired viscosity μ for the lubricant or grease that may be applied to the component. The conditioning temperature Tc may therefore be a temperature or temperature range sufficient to control and thereby cause a decrease in the viscosity μ of the lubricant or grease on the component. The temperature may depend on the formulation of the lubricant as well as the temperature versus viscosity profile for the lubricant.

The heating device may then be turned on at 216 in order to condition the component and the lubricant or grease. The heating device temperature Td may then be separately monitored and at 218 a determination may be made as to whether the actual heating device temperature Td is greater or equal to the targeted conditioning temperature Tc. If the heating device temperature Td is not equal to or greater than Tc the inquiry may be made again at 218. This inquiry may occur at a given time interval, such as between 1 and 50 milliseconds and any increment therebetween such as 10 ms, 11 ms, etc. Alternatively, the inquiry may occur at every clock pulse or a number of clock pulses of the processor.

If the heating device temperature Td is equal to or greater than the conditioning temperature Tc at 218, then the acclimation timer may be started and incremented at 220. An inquiry may then be made as to whether a sufficient amount of time has passed for the heating device to be acclimated at 222. If sufficient time has not passed then a new inquiry can be considered at 218 as to whether the heating device temperature Td is greater than or equal to the conditioning temperature Tc. Alternatively, an inquiry may made be made again as to whether a sufficient amount of time has passed for the heating device to acclimate at 222 without rechecking the heating device temperature Td (not illustrated.)

If sufficient time for the component to acclimate has passed at 222 wherein the lubricant or grease may achieve the desired viscosity, then the motor controlling the roller and/or the component may begin rotating at 224. The motor may begin at a first rotational speed that is less than the speed that may be necessary for printing. It should be appreciated that the first rotational speed may be less than half of the necessary speed for printing and that rotating the roller may also allow for warm-up of the roller.

It should be appreciated that if desired at 226, the heating device temperature Td may be incrementally adjusted upwards to a heating device temperature Td that may be necessary for actual printing. For example, the heating device may be ramped up to an intermediate temperature or it may be ramped up to printing temperature. At 228 an inquiry may be made as to whether the ramp-up is complete. If no, the system may continue to ramp the heating device temperature Td as necessary.

Figure 3:
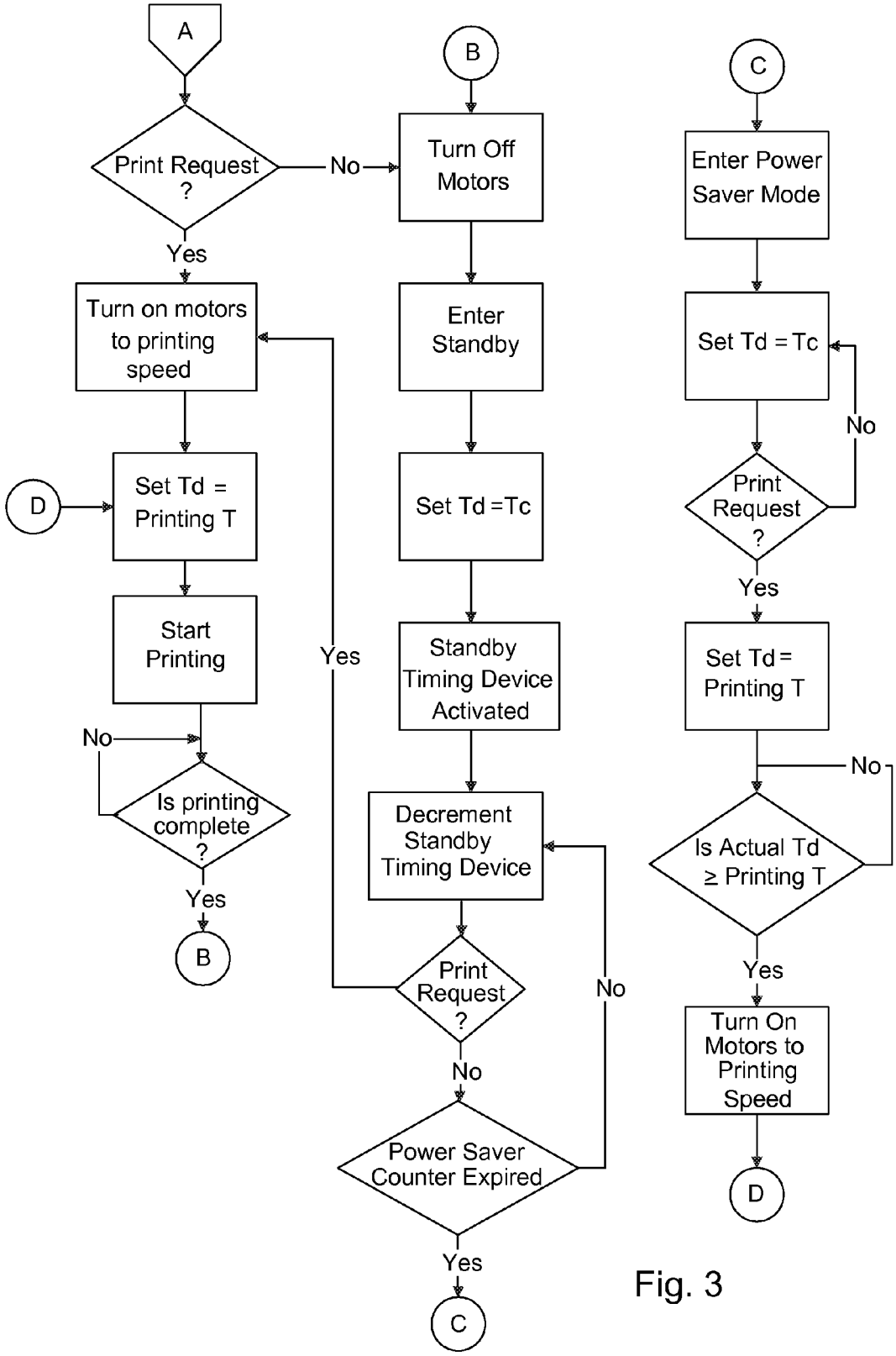

After warm up is completed at 228, a print request may then be considered at 310, referring to FIG. 3. It should be appreciated that up until this point, the image forming apparatus may have received print jobs and those print jobs may have been stored in a memory device, which may for example be located in the controller C, (illustrated in FIG. 1). If no printing request is received, the image forming apparatus may enter standby mode at 322, or alternatively power save mode at 336. If a printing request is received, the motor speed may be increased to printing speed at 312. At 314, the heating device temperature Td may be checked or set to printing temperature $T_{print}$ depending upon the ramp-up temperature for the fuser selected at 226. Printing may then begin at 316. A determination may be made as to whether printing has been completed at 318.

Once a determination has been made that printing may be complete at 318, the image forming apparatus may turn off the motors at 322 and enter standby mode at 324 or power save mode at 336. In standby mode, the heating device temperature may be set at 326 to again provide a conditioning temperature for the lubricant or grease so that it again provides a targeted viscosity. The temperature of the heating device in standby mode may also remain at print temperature.

When in standby mode, a standby timing device may begin to determine if and/or when to enter a power save mode at 328. The standby timing device may be changed at 330. Then a determination of whether a print request has been made may occur at 332. If a print request has been made, then the image forming apparatus may turn on the motors to printing speed at 312. If a request has not been made then at a determination may then be made as to whether the standby timing device has expired at 334. If the standby timing device has not expired the count may be changed again at 330.

The image forming apparatus may enter power saver mode at 336 if the standby timing device has expired or alternatively, in place of entering standby mode at 324. In the context of the present invention, a power saver mode may be understood as any mode wherein the system may draw reduced power and in which the fuser assembly may be maintained at a given temperature. Accordingly, once in power saver mode the temperature of the heating device Td may again be set at 338 to provide a conditioning temperature or temperature range for the lubricant or grease so that it again provides target viscosity or viscosity range. It can be appreciated that when in power saver mode a continuous low heat may be applied by the heating device, which may provide the conditioning temperature for the lubricant or grease.

Accordingly, it should be clear that the conditioning temperature in power saver mode may again be sufficient to keep the lubricant at the desired viscosity μ. Once in power saver mode, a determination may be made as to whether a print request has been generated for the image forming apparatus at 340. If a printing request has not been made, then the heating device may remain or continue to adjust to maintain the conditioning temperature at 338. If a print request is issued at 340, then the heating device may be brought up to printing temperature at 342.

A determination may then be made as to whether the actual temperature of the heating device Td is equal to or greater than the printing temperature at 344. If the temperature is not greater than or equal to the printing temperature, then the inquiry may be made again at 344 after a desired time period such as between 1 millisecond and 50 milliseconds and any increment therebetween including 10 milliseconds, 16 milliseconds, etc. or after a desired number of clock pulses. The component motor may then be turned on to printing speed at 346. Once the motors are turned on, printing may begin at 314.

It may also be appreciated that the functionality described herein for the embodiments of the present invention may be implemented by using hardware, software, or a combination of hardware and software, either within the image forming apparatus or outside the image forming apparatus, as desired. If implemented by software, a processor and a machine readable medium are required. The processor may be of any type of processor capable of providing the speed and functionality required by the embodiments of the invention. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format.

Figure 4:
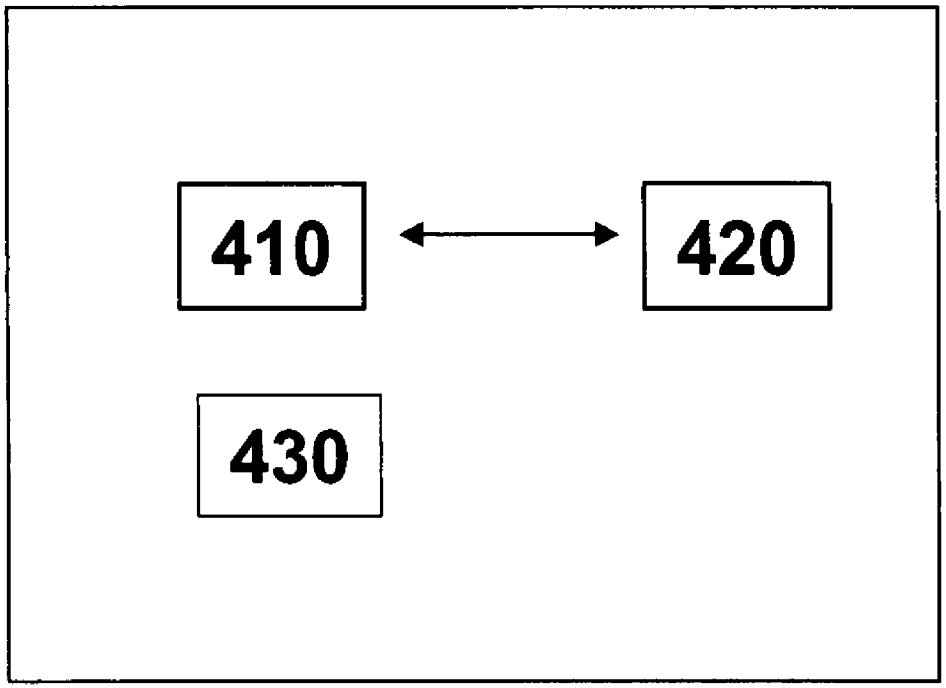
FIG. 4 is an illustration of an exemplary embodiment of the present invention relating to an article of machine readable media in relation to a processor and a user interface.

Accordingly, in the broad context of the present invention, and with attention to FIG. 4, the image forming apparatus may contain a processor 410 and machine readable media 420 and user interface 430. It should be appreciated that the user interface may be any interface that the user has with the image forming apparatus, or any device that may be in communication with the image forming apparatus in which the user may input into the image forming apparatus. Devices in communication with the image forming apparatus may include, but are not limited to, computers, cameras, storage media, scanners, or other devices.

The foregoing description is provided to illustrate and explain the present invention. However, the description hereinabove should not be considered to limit the scope of the invention set forth in the claims appended here to.

What is claimed is:

1. A method of thermally conditioning an image forming apparatus including a heating device and a component wherein the component includes a lubricant and the lubricant is capable of exhibiting a targeted viscosity at a first selected temperature, comprising:

setting said heating device to said first selected temperature, wherein said first selected temperature is less than a printing temperature and greater than a temperature of said heating device when not heated, and heating said heating device to said first selected temperature;

maintaining said heating device at said first selected temperature for a selected time prior to moving said component including said lubricant, said selected time being greater than an amount of time for said heating device to be at said first selected temperature temporarily while being heated to a temperature greater than the first selected temperature;

moving said component at a first velocity that is lower than a printing velocity of said image forming apparatus after maintaining said heating device at said first selected temperature for said selected time, wherein said setting, heating and maintaining said heating device and moving said component at a first velocity are independent of receiving a print request by the image forming apparatus; and following said selected time, heating said heating device to a second selected temperature greater than the first selected temperature, wherein heating said heating device to the second selected temperature is independent of receiving a print request by the image forming apparatus; and following said heating device reaching said second selected temperature, determining whether a print request has been received since said setting of said heating device.

2. The method of claim 1 including increasing a velocity of said component from said first velocity to a printing velocity prior to a start of printing.

3. The method of claim 1 wherein maintaining said heating device at said first selected temperature for said selected time heats said component.

4. The method of claim 1 wherein after maintaining said heating device at said first selected temperature for said selected time said lubricant exhibits said targeted viscosity.

5. The method of claim 1 wherein said heating device is provided in a cold start mode wherein said heating device is initially at ambient temperature.

6. The method of claim 1 wherein said heating device is provided in a power saver mode wherein said heating device is at said first selected temperature.

7. The method of claim 1, further comprising:

entering into a standby mode of operation upon an affirmative determination that a print request has not be received.

8. The method of claim 7, further comprising:

following entering into the standby mode of operation, heating said heating device to said first selected temperature until a print request is received.

9. An image forming apparatus comprising:

a heating device;

a component including a lubricant wherein said lubricant exhibits a targeted viscosity at a first selected temperature; and a processor in communication with said heating device, wherein said processor is configured to control said heating device to set said heating device to a first selected temperature, wherein said first selected temperature is less than a printing temperature but greater than a temperature when said heating device is not powered, and heat to said first selected temperature and maintain said first selected temperature for a selected period of time prior to moving said component including said lubricant, said selected period of time being a time greater than a time said heating device is temporarily at said first selected temperature while being heated to a temperature greater than said first selected temperature, wherein said processor is further configured to move said component at a first velocity that is lower than a printing velocity of said image forming apparatus after maintaining said heating device at said first selected temperature for said selected period of time, wherein heating and maintaining said heating device and moving said component at a first velocity are independent of receiving a print request by the image forming apparatus;

wherein the processor, following maintaining said heating device at said first selected temperature for said selected period of time, heats said heating device to a second selected temperature greater than the first selected temperature independent of receiving a print request by the image forming apparatus, and following said heating device reaching said second selected temperature determines whether a print request has been received since said heating device was heated to said first selected temperature.

10. The image forming apparatus of claim 9 further comprising a timer configured to measure said selected period of time.

11. The image forming apparatus of claim 9 wherein said processor is further configured to increase a velocity of said component from said first velocity to a printing velocity prior to start of printing.

12. The image forming apparatus of claim 9 wherein said heating device is a ceramic heating device.

13. The image forming apparatus of claim 9 wherein said component is a belt.

14. The apparatus of claim 9, wherein the processor, upon a determination that a print request has not been received, heats said heating device to said first selected temperature until a print request is received.

15. An article comprising:

a storage medium having stored thereon instructions that when executed by a machine result in the following operations:

setting a heating device to a first selected temperature, wherein said first selected temperature is less than a printing temperature and greater than a temperature when said heating device is not heated, and heating said heating device in a printing apparatus including a component to said first selected temperature, wherein said first selected temperature provides a selected lubricant viscosity;

maintaining said heating device at said first selected temperature for a selected period of time prior to moving said component, said selected period of time being greater than a time at which said heating device is temporarily at said first selected temperature while being heated to a higher temperature than said first selected temperature;

moving said component at a first velocity that is lower than a printing velocity of said printing apparatus after maintaining said heating device at said first selected temperature for said selected period of time, wherein heating said heating device and moving said component at a first velocity are independent of receiving a print request by the image forming apparatus;

heating said heating device to a second selected temperature which is greater than said first selected temperature independent of receiving a print request by the image forming apparatus; and following said heating device being heated to said second selected temperature, heating said heating device to said first selected temperature upon a determination that no print request has been received, until a print request is received.

16. The article of claim 15 wherein said storage medium has stored thereon instructions that when executed by said machine result in the further following operations:

increasing a velocity of said component from said first velocity to a printing velocity prior to start of printing.

17. The article of claim 15, wherein said storage medium has stored thereon instructions that when executed by said machine result in said heating device being heated to said second selected temperature following said selected period of time.

18. The article of claim 15, wherein said second selected temperature is less than a printing temperature of said heating device.

* * * * *